United States Patent [19]

Hayashi

[11] 4,284,093

[45] Aug. 18, 1981

[54] CHANGE DISPENSING MACHINE

[75] Inventor: Takaaki Hayashi, Kawasaki, Japan

[73] Assignee: Fuji Electric Co., Ltd., Kawasaki, Japan

[21] Appl. No.: 48,115

[22] Filed: Jun. 13, 1979

[30] Foreign Application Priority Data

Jun. 13, 1978 [JP] Japan ..... 53-70386

[51] Int. Cl.[3] ..... G07D 1/02

[52] U.S. Cl. ..... 133/4 A; 133/5 R

[58] Field of Search ..... 133/2, 4 R, 4 A, 5 R; 221/129, 131

[56] References Cited

U.S. PATENT DOCUMENTS

| | | | |
|---|---|---|---|
| 2,204,853 | 6/1940 | Goodman | 133/5 R X |
| 3,972,338 | 8/1976 | Schmitt | 133/4 A |
| 4,080,973 | 3/1978 | Kobayashi | 133/5 R |

*Primary Examiner*—F. J. Bartuska

*Attorney, Agent, or Firm*—Sughrue, Mion, Zinn, Macpeak and Seas

[57] ABSTRACT

A change dispensing machine having a change dispensing board with change receiving inlets adapted to receive change coins. The change dispensing board is reciprocated by the operation of an electric motor or an electromagnet to dispense change coins received by the change receiving inlets. Slide boards are provided under the change dispensing board, for holding the change coins received by the change receiving inlet and connecting pin holes are formed in the change dispensing board. Connecting pins engage with the connecting pin holes so that the slide boards reciprocate with the reciprocation of the change dispensing board. The connecting pins are disengaged from the connecting pin holes so that reciprocation of the slide boards is released. First elastic members provide restoring forces to said connecting pins so that solenoids are released from the reciprocation of the change dispensing board. Second elastic members provide restoring forces to the plungers so that the slide boards are reciprocated with the change dispensing board. The slide boards engage with said change dispensing board with the aid of the connecting pins when the change coins are not dispensed and are disengaged when the change coins are dispensed.

8 Claims, 4 Drawing Figures

CHANGE DISPENSING MACHINE

BACKGROUND OF THE INVENTION

This invention relates to a change dispensing machine adapted to dispense change coins in an automatic vending machine.

FIG. 1 is a schematic diagram showing a conventional change dispensing machine of this type. In FIG. 1, reference character A designates change dispensing boards; C, disks rotated by an electric motor with a reduction gear (not shown); and D, slots formed in the end portions of the change dispensing boards A. The disks C have protrusions B engaged with the slots D of the change dispensing boards A so that the change dispensing boards A are slidably moved along guide boards (not shown) in the directions of P—P. In FIG. 1, reference characters E designates stacks of change coins. The change dispensing boards A are provided with change receiving inlets (not shown). As is apparent from FIG. 1, one change dispensing board A is provided for each stack of change coins. Only the change dispensing board A required for change dispensation is operated, so that the change coins are dispensed through a change dispensing outlet (not shown).

The conventional change dispensing machine is disadvantageous in the following points: Since the guide boards must be provided for the change dispensing boards A, respectively, it is necessary to provide a predetermined distance a between adjacent change dispensing boards A. Therefore, it is difficult to provide a sufficient number of stacks of change coins E in the limited internal space in the automatic vending machine. Accordingly, sometimes it is impossible to dispense the necessary number of change coins.

This difficulty may be eliminated by increasing the height of each stack of change coins. However, the increment of the height of the coin stack is also limited in the limited space in the vending machine. Consequently, in order to eliminate the drawback, there is no other way than increasing the number of coin stacks. However, it is impossible to increase the number of coin stacks because it is impossible to reduce the distance a between adjacent change dispensing boards A in the conventional change dispensing machine.

SUMMARY OF THE INVENTION

Accordingly, an object of this invention is to provide a change dispensing machine in which all of the above-described difficulties accompanying a conventional change dispensing machine have been eliminated.

It is another object of this invention to provide a change dispensing machine where a necessary number of stacks of change coins can be loaded in the limited internal space to eliminate the shortage in change dispensing and the dispensing is positively carried out with high reliability.

The foregoing and other objects of the invention are achieved by the provision of a change dispensing machine which, according to the invention, comprises: a change dispensing board having change receiving inlets adapted to receive change coins. The change dispensing board is reciprocated by the operation of an electric motor or electromagnet means to dispense the change coins received by the change receiving inlets. Slide boards are provided under the change dispensing board for holding the change coins received by the change receiving inlet on the top surfaces thereof. Connecting pin holes are formed in the change dispensing board and, connecting pins are engaged with the connecting pin holes so that the slide boards are reciprocated with the reciprocation of the change dispensing board. The connecting pins are disengaged from the connecting pin holes so that the reciprocation of the slide boards is released.

Solenoids having plungers are adapted to move the connecting pins and first elastic members provide restoring forces to the connecting pins so that the solenoids are released from the reciprocation of the change dispensing board. Second elastic members provide restoring forces to the plungers so that the slide boards are reciprocated with the change dispensing board. The slide boards engage the change dispensing board with the air of the connecting pins when the change coins are not dispensed and the slide boards are disengaged from the change dispensing board with the aid of the connecting pins when the change coins are dispensed.

One example of a change dispensing machine according to this invention will be described with reference to the accompanying drawings in detail.

DESCRIPTION OF THE PREFERRED EMBODIMENT

Figure 1:
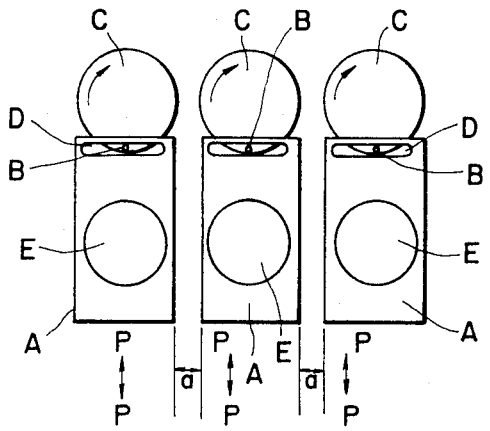
FIG. 1 PRIOR ART
FIG. 1 is a schematic diagram showing the arrangement of a conventional change dispensing machine.
Figure 2:
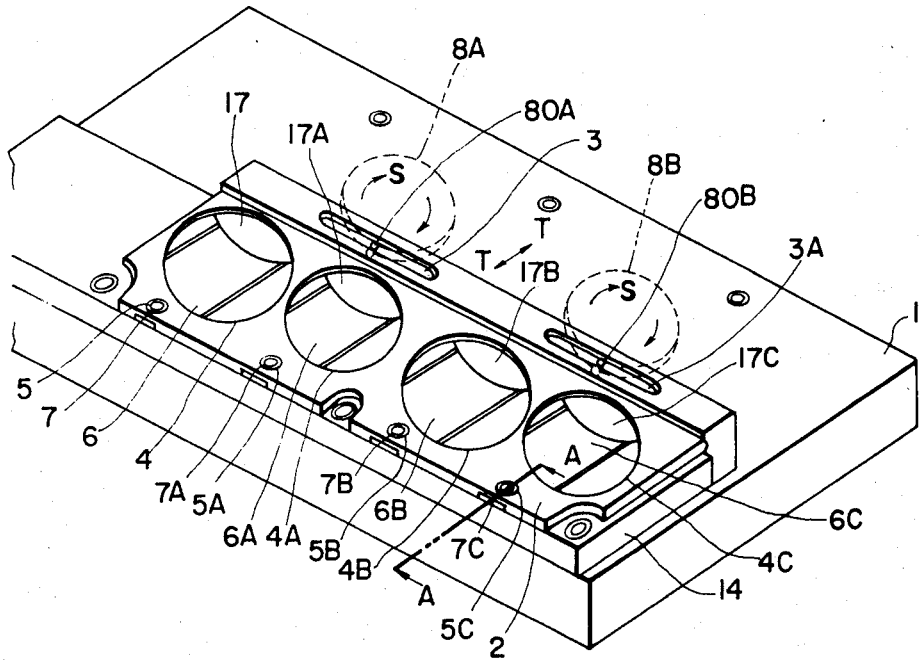
FIG. 2 is a schematic diagram showing one example of a change dispensing machine according to this invention.

FIG. 2 is a schematic diagram showing the arrangement of the change dispensing machine according to the invention. The change dispensing machine comprises a base board 1 on which a stationary board 14 is provided, and a change dispensing board 2 provides on the stationary board 14. The change dispensing board 2 has two slots 3 and 3A, four change receiving inlets 4, 4A, 4B and 4C, and connecting pin holes 5, 5A, 5B and 5C. The slots 3 and 3A engage the protrusions 80A and 80B of the rotary disks 8 and 8A, respectively. Therefore, as the rotary disks 8 and 8A are turned in the direction of the arrow S by a reduction gear drive motor (not shown), the change dispensing board 2 is reciprocated in the directions T—T.

Slide boards 6, 6A, 6B and 6C are provided under the change dispensing board 2. Connecting pins 7, 7A, 7B and 7C engage with the connecting pin holes 5, 5A, 5B and 5C, respectively, so that the slide boards 6 through 6C reciprocate with the reciprocation of the change dispensing board 2. In order to suspend the reciprocation of the slide boards 6 through 6C, the connecting pins 7 through 7C are disengaged from the respective holes 5 through 5C. In FIG. 2, reference characters 17, 17A, 17B and 17C designate change dispensing outlets.

Figure 3:
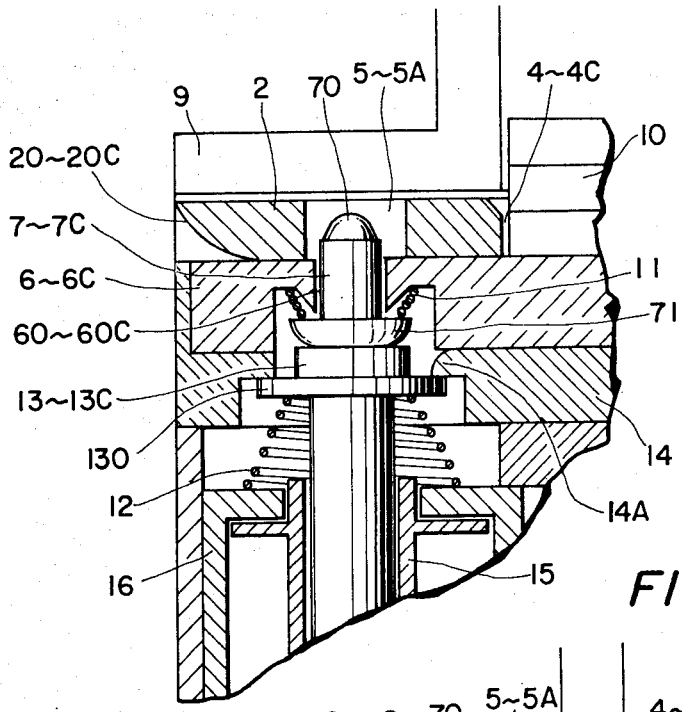
FIG. 3 is an enlarged sectional view taken along line A—A in FIG. 2, showing the machine which is in change dispensing standby state.

FIG. 3 is an enlarged sectional view taken along line A—A in FIG. 2, showing the machine which is in the standby state.

In FIG. 3, those components which have been previously described with reference to FIG. 2 have therefore been similarly numbered.

The change dispensing board 2 has change receiving inlets 4 through 4C, connecting pin holes 5 and 5A, and arcuate guides 20, 20A, 20B and 20C. The slide boards 6 through 6C have guide holes 60, 60A, 60B and 60C provided for the connecting pins 7 through 7C, respectively. The connecting pins 7 through 7C are moved up and down by plungers 13 through 13C driven by solenoids in a yoke 16. The connecting pins 7 through 7C have round heads 70, respectively.

A spring 11 is interposed between each slide board (6) and the spring retainer 71 of each connecting pin (7). Furthermore, a spring 12 is interposed between the spring retainer 130 of each plunger (13) and the yoke 16. Bobbins 15 are provided for the plungers 13 through 13C, so that they will guide the plungers 13 through 13C when the plungers are moved vertically. In FIG. 2, reference numeral 9 designates a top cover, and reference numeral 10 designates a change coin stack.

The operation of the change dispensing machine thus constructed will be described.

When the solenoids are not engaged, the plungers 13 through 13C are placed in standby state by the restoring forces of the springs 12. In this case, the springs 11 are compressed and the connecting pins 7 through 7C are inserted through the guide holes 60 through 60C into the connecting pin holes 5 through 5C, respectively. The change dispensing board 2 is slidably reciprocated by the motor (not shown), and therefore the slide boards 6 through 6C are also slidably reciprocated along the stationary board 14 because the connecting pins 7 through 7C have been engaged with the respective holes 5 through 5C of the change dispensing board 2. Accordingly, the change coins 10 on the silde boards 6 through 6C are moved with the change dispensing board 2, and therefore they are not dispensed. When the change dispensing board 2 is returned to the standby position as shown in FIG. 3, the change coins 10 are also returned to the standby position.

Since the slide boards 6 through 6C together with the change dispensing board 2 are slid along the stationary board 14, the connecting pins 7 through 7C are also slid on the top surfaces of the plungers 13 through 13C and on the stationary board 14. In this connection, it should be noted that the spring retainer 71 of each connecting pin (7) has an arcuate bottom and the stationary board 14 has an arcuate edge 14A, so that the connecting pins 7 through 7C are smoothly shifted from the plungers to the stationary board 14.

Figure 4:
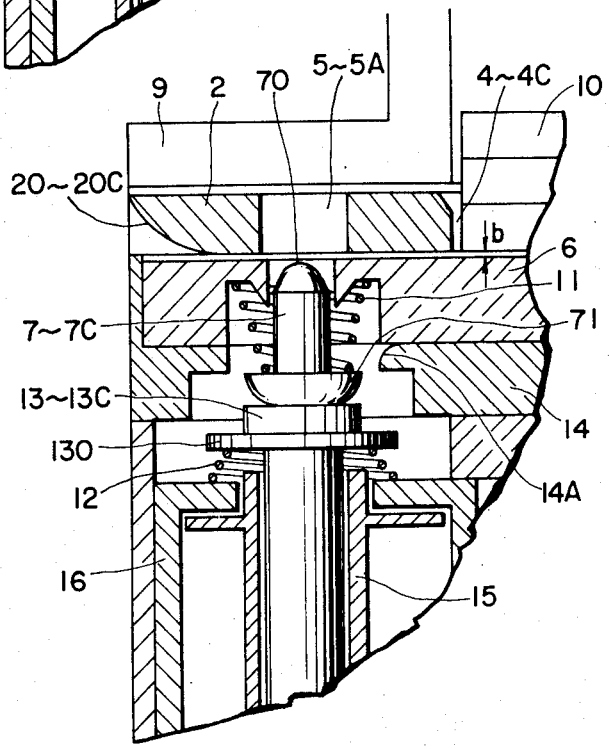
FIG. 4 is also an enlarged sectional view taken along line A—A in FIG. 2, showing the machine which is instructed to dispense change coins.

FIG. 4 is also an enlarged sectional view taken along line A—A in FIG. 2, showing the machine which is in change dispensing instruction state. In FIG. 4, those components which have been described with reference to FIGS. 2 and 3 have been therefore similarly numbered. It is assumed that the motor, and for instance the solenoid of a particular plunger 13 among the plungers 13 through 13C are energized upon the issuance of a change dispensing instruction. Then, the plunger 13 is attracted, and therefore the connecting pin 7 on the plunger 13 is disengaged from the connecting pin hole 5 of the change dispensing board 2 with the aid of the elastic force of the spring 11. Therefore, while the change dispensing board 2 is reciprocated by the motor (not shown), the slide board 6 is not reciprocated with the change dispensing board 2. That is, it is maintained stopped at the standby position. Accordingly, the change coins 10 on the slide board 6 are dispensed through the change dispensing outlet 17 shown in FIG. 2 by the change dispensing board 2. In this case, on the other hand, the remaining plungers 13A through 13C are placed in the standby state because their plungers are not energized. That is, the slide boards 6A through 6C are reciprocated with the change dispensing board 2, and therefore the change coins 10 on these boards are not dispensed.

When, during this change dispensing operation, the solenoid is deenergized, the connecting pin 7 protrudes into the hole of the change dispensing board 2 as shown in FIG. 2. In this operation, the round head 70 of the connecting pin 7 is depressed by the arcuate guide 20 of the change dispensing board 2. As a result, the connecting pin is moved downwardly once. Thereafter, when the round head 70 reaches the connecting pin hole 5, the connecting pin 7 is moved upwardly; that is, the connecting pin 7 is inserted into the hole 5. Thus, the machine is placed in the standby state again as shown in FIG. 3.

If a small gap b is provided between the change dispensing board 2 and the slide boards 6 through 6C as shown in FIG. 4, then the change dispensing board 2 and the slide boards 6 through 6C can be operated without contact. In the abovedescribed example, a motor is employed to reciprocate the change dispensing board; however, the motor may be replaced by electromagnet means, so that the change dispensing board is reciprocated by the attraction and repulsion of the electromagnet means.

As is apparent from the above description, the change dispensing system utilizing one change dispensing board reciprocated by the electromagnetic means or the motor, the slide boards slid with change coins, and the solenoids adapted to move and stop the slide boards is provided according to the invention. With this change dispensing system, it is possible to reduce the distance between adjacent stacks of change coins, and therefore a necessary number of stacks of change coins can be incorporated in a limited space. Thus, the shortage in change dispensing can be eliminated. Furthermore, the dispensing operation is positive and accurate, which leads to an improvement of the reliability of the change dispensing machine. Thus, the effects of the invention are significant.

What is claimed is:

1. A change dispensing machine comprising:

a change dispensing board having change receiving inlets adapted to receive coins, said change dispensing board being reciprocated to dispense said coins received by said change receiving inlets;

a plurality of slide boards provided under said change dispensing board, said slide boards holding said coins received by said change receiving inlet on top surfaces thereof;

connecting pin holes formed in said change dispensing board;

connecting pins engagable with said connecting pin holes such that said slide boards are selectively reciprocated with the reciprocation of said change dispensing board, whereby when connecting pins are disengaged from said connecting pin holes the reciprocation of said slide boards is released;

means adapted to move said connecting pins;

first elastic members for providing a restoring force to said connecting pins when said means to move are released from the reciprocation of said change dispensing board; and second elastic members for providing a restoring force to said means to move whereby said slide boards are reciprocated with said change dispensing board, whereby said slide boards are engaged with said change dispensing board by said connecting pins when said coins are not dispensed, and said slide boards are disengaged from said change dispensing board by retraction of said connecting pins when said change coins are dispensed.

2. The change dispensing machine of claim 1 wherein said means adapted to move said connecting pins comprises a plunger adapted to reciprocate and coupled to a connecting pin and guide means to align the movement of said plunger with a connecting pin.

3. The change dispensing machine of claims 1 or 2 further comprising a spring retainer disposed on one end of a connecting pin, and wherein said first elastic means comprises a spring disposed around a connecting pin between a slide board and said spring retainer.

4. The change dispensing machine of claim 2 further comprising a spring retainer disposed on said plunger and wherein said second elastic means comprises a spring disposed around said plunger between said spring retainer and said guide means.

5. The change dispensing machine of claim 4 further comprising a stationary board positioned under said slide boards, and a lip member in said stationary board to define a stop for said spring retainer.

6. The change dispensing machine of claims 1, 2 or 4 further comprising a gap between said slide boards and said change dispensing board.

7. The change dispensing machine of claim 1 further comprising means to reciprocate said change board, said means to reciprocate comprising a rotatable disc and means to convert the rotational motion of said disc into reciprocating motion.

8. The change dispensing machine of claim 7 wherein said means to convert comprises a protrusion mounted on said rotatable disc, and an elongated slot in said change board adapted to receive said protrusion for sliding movement therein.

* * * * *